US012042076B1

(12) United States Patent
Yu

(10) Patent No.: US 12,042,076 B1
(45) Date of Patent: Jul. 23, 2024

(54) COMBINATION STRUCTURE OF DECORATIVE CURTAIN ROD AND TRACK

(71) Applicant: ARLINEA INDUSTRIES CO., Taoyuan (TW)

(72) Inventor: Yu-Heng Yu, Taoyuan (TW)

(73) Assignee: ARLINEA INDUSTRIES CO., Taoyuan (TW)

( * ) Notice: Subject to any disclaimer, the term of this patent is extended or adjusted under 35 U.S.C. 154(b) by 0 days.

(21) Appl. No.: 18/119,379

(22) Filed: Mar. 9, 2023

(51) Int. Cl.
*A47H 13/00* (2006.01)
*A47H 1/02* (2006.01)
(Continued)

(52) U.S. Cl.
CPC ..... *A47H 1/144* (2013.01); *A47H 1/02* (2013.01); *A47H 1/06* (2013.01);
(Continued)

(58) Field of Classification Search
CPC ..... E05F 5/003; E05F 5/10; E05F 1/16; E05F 3/00; E05F 3/02; E05F 3/04; E05F 3/16; E05F 3/18; E05F 1/00; E05F 1/02; E05F 1/046; E05Y 2900/20; E05Y 2800/24; E05Y 2201/408; E05Y 2201/412; E05Y 2201/46; E05Y 2201/418; E05Y 2201/638; E05Y 2201/684; E05Y 2201/218;
(Continued)

(56) References Cited

U.S. PATENT DOCUMENTS 3,129,751 A * 4/1964 Weber ..... A47H 1/06 160/354
3,291,194 A * 12/1966 Kirtley ..... E06B 9/36 248/222.13
(Continued)

FOREIGN PATENT DOCUMENTS

CN 206261415 U 6/2017
GB 1244385 A 9/1971
(Continued)

OTHER PUBLICATIONS

Office Action dated Feb. 13, 2023 of the corresponding Taiwan patent application No. 111135696.
(Continued)

*Primary Examiner* — Chuck Y Mah
(74) *Attorney, Agent, or Firm* — Chun-Ming Shih; HDLS IPR SERVICES

(57) ABSTRACT

This disclosure is a combination structure of a decorative curtain rod and a track. A decorative rod (10) includes a rod body (11) and an L-shaped opening (12). Multiple locking sets (20) are arranged spacedly on the L-shaped opening (12). Each locking set (20) includes a locking plate (21) and a locking piece (22). The locking plate (21) includes a plate body (211) and multiple blocking pieces (212). The blocking pieces (212) are arranged on the plate body (211) to form an insertion space (210). The locking plate (21) is combined on the rod body (11) to be rotatable. The track (30) includes a column (31) and a sliding slot (32). The column (31)
(Continued)

includes a fixing plate (311) and a pair of wings (312). The wings (312) penetrate into the insertion space (210) and are blocked by the blocking pieces (212) to be combined in the L-shaped opening (12).

10 Claims, 12 Drawing Sheets

(51) Int. Cl.

| | |
|---|---|
| ***A47H 1/06*** | (2006.01) |
| ***A47H 1/144*** | (2006.01) |
| *A47H 1/00* | (2006.01) |
| *A47H 13/02* | (2006.01) |
| *A47H 15/02* | (2006.01) |

(52) U.S. Cl.
CPC ..... *A47H 2001/006* (2013.01); *A47H 13/02* (2013.01); *A47H 15/02* (2013.01)

(58) Field of Classification Search
CPC ..... E05Y 2201/224; E05Y 2201/212; E05Y 2900/132; E05D 15/063; E05D 15/0621; E05D 15/0652; E05D 15/0678; E05D 15/0686; E05D 15/565; E05D 15/0647; A47H 1/08; A47H 15/02; A47H 15/04; A47H 2001/047; A47H 2001/006; A47H 1/02; A47H 1/06; A47H 1/10; A47H 1/102; A47H 1/104; A47H 1/12; A47H 1/122; A47H 1/124; A47H 1/13; A47H 1/14; A47H 1/142; A47H 1/144; A47H 13/02
See application file for complete search history.

(56) References Cited

U.S. PATENT DOCUMENTS

| | | | | | |
|---|---|---|---|---|---|
| 3,927,437 | A * | 12/1975 | Ford | A47H 1/144 | 16/94 R |
| 4,344,206 | A * | 8/1982 | Hermanson | E05D 15/0652 | 16/94 R |
| 4,406,436 | A * | 9/1983 | Benthin | A47H 1/144 | 248/262 |
| 4,935,988 | A * | 6/1990 | Ford | A47H 1/02 | 160/168.1 V |
| 5,259,520 | A * | 11/1993 | Roggio | A47H 15/04 | 16/95 D |
| 5,584,459 | A * | 12/1996 | Meyer | E06B 9/323 | 160/902 |
| 6,499,708 | B1 * | 12/2002 | Cowen | A47H 13/02 | 248/261 |
| 7,637,302 | B2 * | 12/2009 | Drew | E06B 9/323 | 248/220.21 |
| 2008/0156951 | A1 * | 7/2008 | Lin | A47H 1/104 | 248/261 |
| 2009/0205791 | A1 * | 8/2009 | Sans Folch | A47H 15/02 | 160/368.1 |
| 2013/0167326 | A1 * | 7/2013 | Rowan | A47H 15/02 | 16/94 D |
| 2016/0374496 | A1 * | 12/2016 | Marcinik | A47H 15/02 | 160/331 |
| 2017/0002606 | A1 * | 1/2017 | Yu | A47H 13/04 | |
| 2017/0280909 | A1 * | 10/2017 | Frett | A47H 1/10 | |
| 2020/0352380 | A1 * | 11/2020 | Yu | A47H 5/0325 | |

FOREIGN PATENT DOCUMENTS

| | | | |
|---|---|---|---|
| JP | 2005066209 | A | 3/2005 |
| TW | M276526 | U | 10/2005 |
| TW | M493951 | U | 1/2015 |
| TW | M509001 | U | 9/2015 |

OTHER PUBLICATIONS

Search Report dated Aug. 8, 2023 of the corresponding European patent application No. 23157404.7.

* cited by examiner

COMBINATION STRUCTURE OF DECORATIVE CURTAIN ROD AND TRACK

BACKGROUND OF THE DISCLOSURE

Technical Field

This disclosure relates to a curtain, and more particularly relates to a combination structure of a decorative curtain rod and a track.

Description of Related Art

A modern curtain may be combined with a decorative panel on an outer side of the curtain rod hanging a curtain fabric for aesthetic purpose to make the curtain have a unique style as a whole. Thus, the overall quality may be improved.

Moreover, the decorative panel of curtains of the related art are installed on the outside of the curtain rod by screws, or inserted in the dovetail groove on the outside of the curtain rod. However, this installation of the related art decorative panel is cumbersome and difficult, so it needs to be improved.

The installation of the curtain track of the related art is to combine multiple brackets on the wall first, and then to combine the track on these brackets. However, there are many components between the curtain track and the brackets, and that may increase the difficulty of assembly.

In view of the above drawbacks, the inventor proposes this disclosure based on his expert knowledge and elaborate researches in order to solve the problems of related art.

SUMMARY OF THE DISCLOSURE

One object of this disclosure is to provide a combination structure of a decorative rod and a track to simplify the combination of a decorative rod and a track for increasing the convenience of assembly.

This disclosure provides a combination structure of a decorative curtain rod and a track. The combination structure includes a decorative rod, a plurality of locking sets and a track. The decorative rod includes a rod body and an L-shaped opening disposed on a side of the rod body. The L-shaped opening is extended from one end of the rod body to another end of the rod body. The plurality of locking sets is arranged spacedly in the L-shaped opening. Each of the plurality of locking set includes a locking plate and a locking piece. The locking plate includes a plate body and a plurality of blocking pieces. The plurality of blocking pieces is arranged in pair and spacedly on the plate body to form an insertion space respectively, and each locking plate is combined on the rod body through the locking piece to be rotatable. The track includes a column and a sliding slot disposed on the column. The column includes a fixing plate and a pair of wings bent and extended from two sides of the fixing plate. The pair of wings and the sliding slot are arranged on two sides of the fixing plate opposite to each other. The track is combined in the L-shaped opening through the locking plate being configured to rotate to make the pair of wings penetrate into the insertion space and be blocked by the blocking pieces.

In comparison with the related art, the combination structure of the decorative curtain rod and the track of this disclosure has an L-shaped opening disposed on the decorative rod. Additionally, the locking sets are arranged spacedly in the L-shaped opening. The locking plate includes a plurality of blocking pieces and is combined on the rod body through the locking pieces to be rotatable. Furthermore, the track has a pair of wings. The wings penetrate into the space of the blocking pieces of the locking plate by rotating the locking plate, and are combined in the L-shaped opening by the blocking of the blocking pieces. As a result, multiple brackets used in the track of the related art for combination are omitted, and the convenience of assembly is increased.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
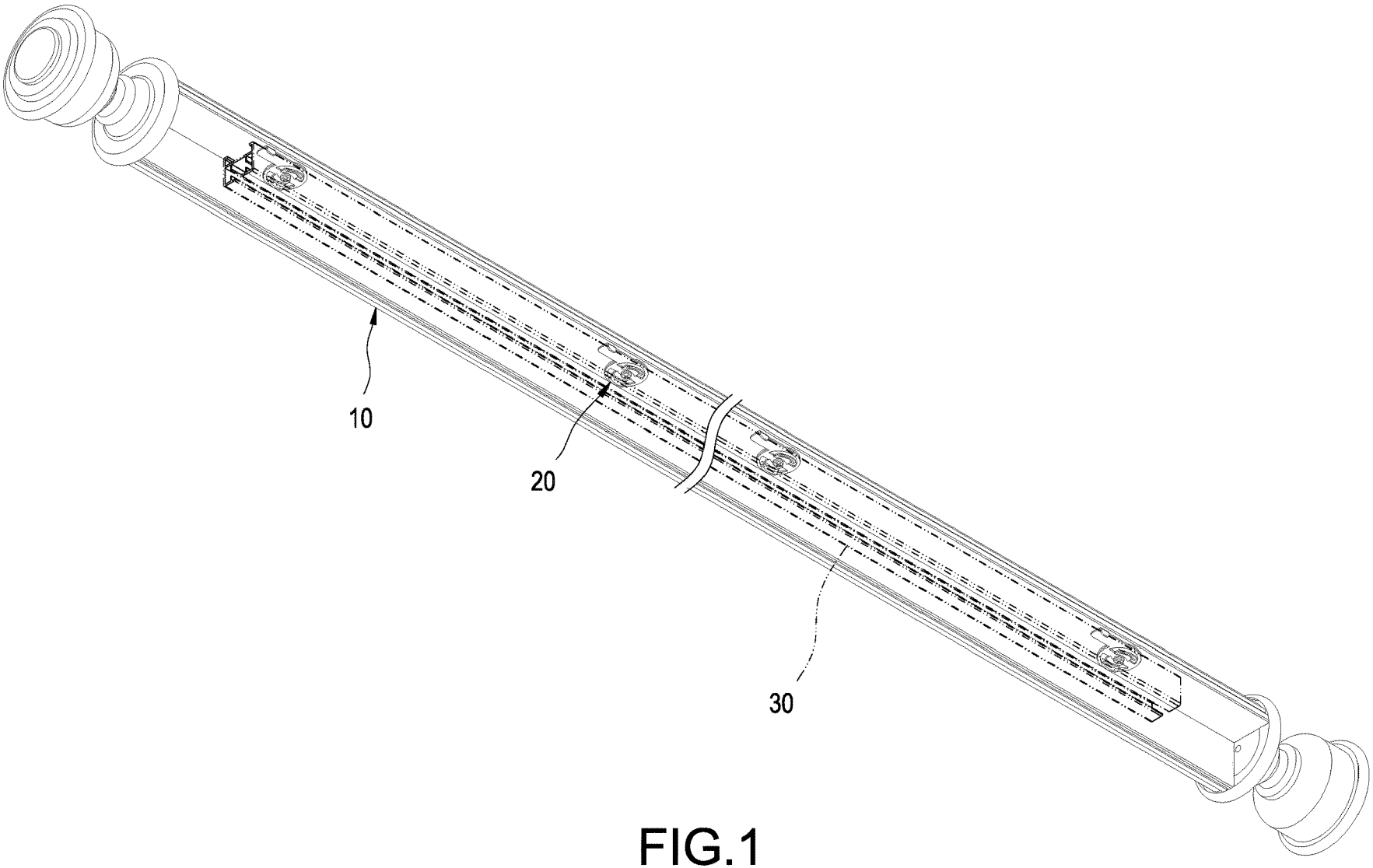
FIG. 1 is a perspective schematic view of the combination structure of the decorative rod and the track in this disclosure.
Figure 2:
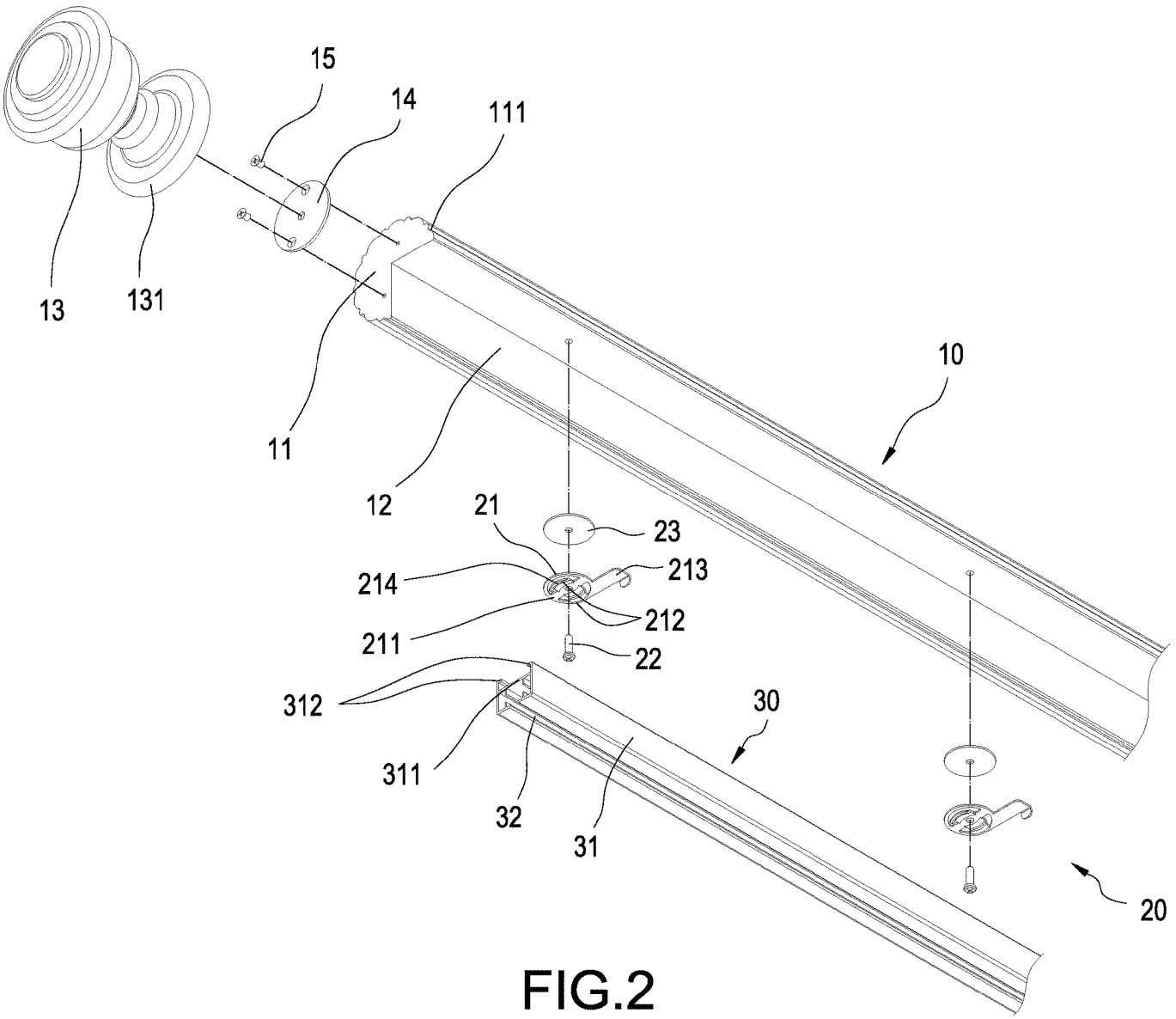
FIG. 2 is an exploded perspective schematic view of the combination structure of the decorative rod and the track in this disclosure.
Figure 3:
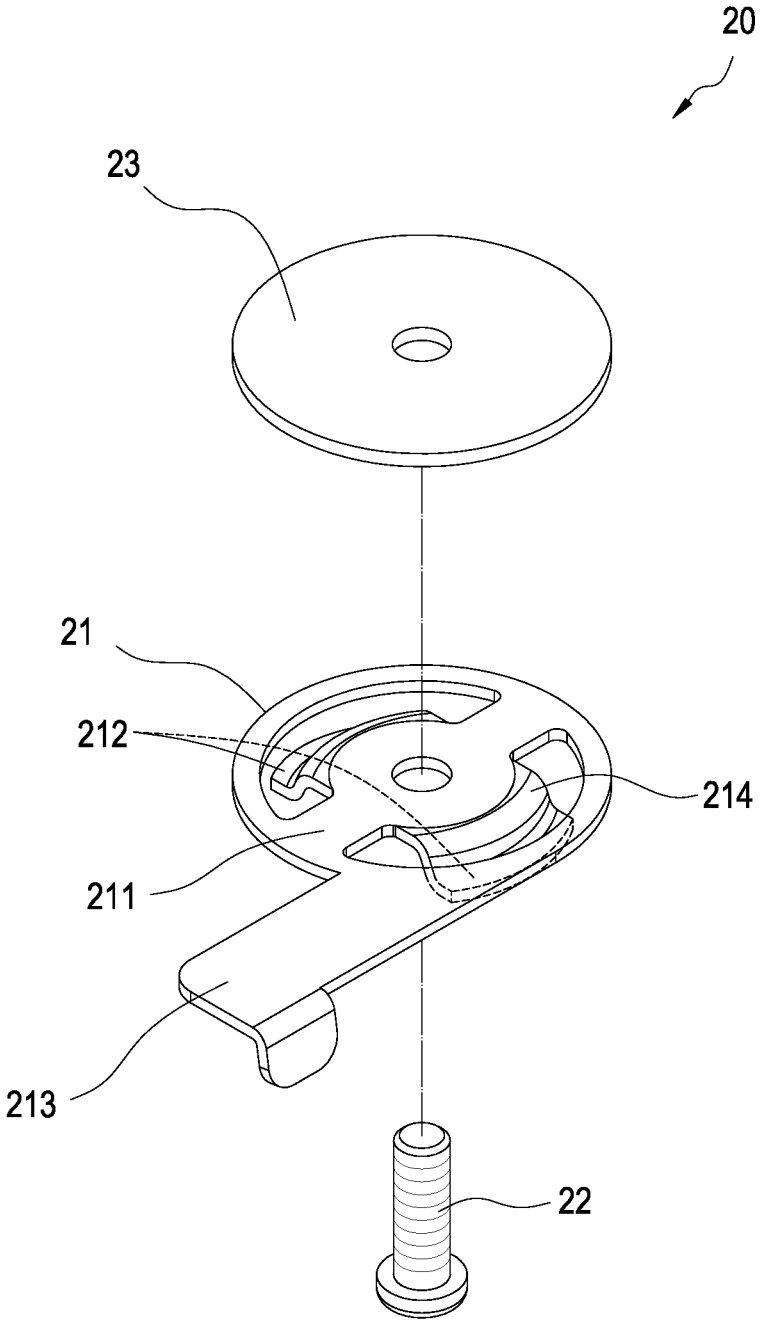
FIG. 3 is a perspective exploded schematic view of the locking set in this disclosure.
Figure 4:
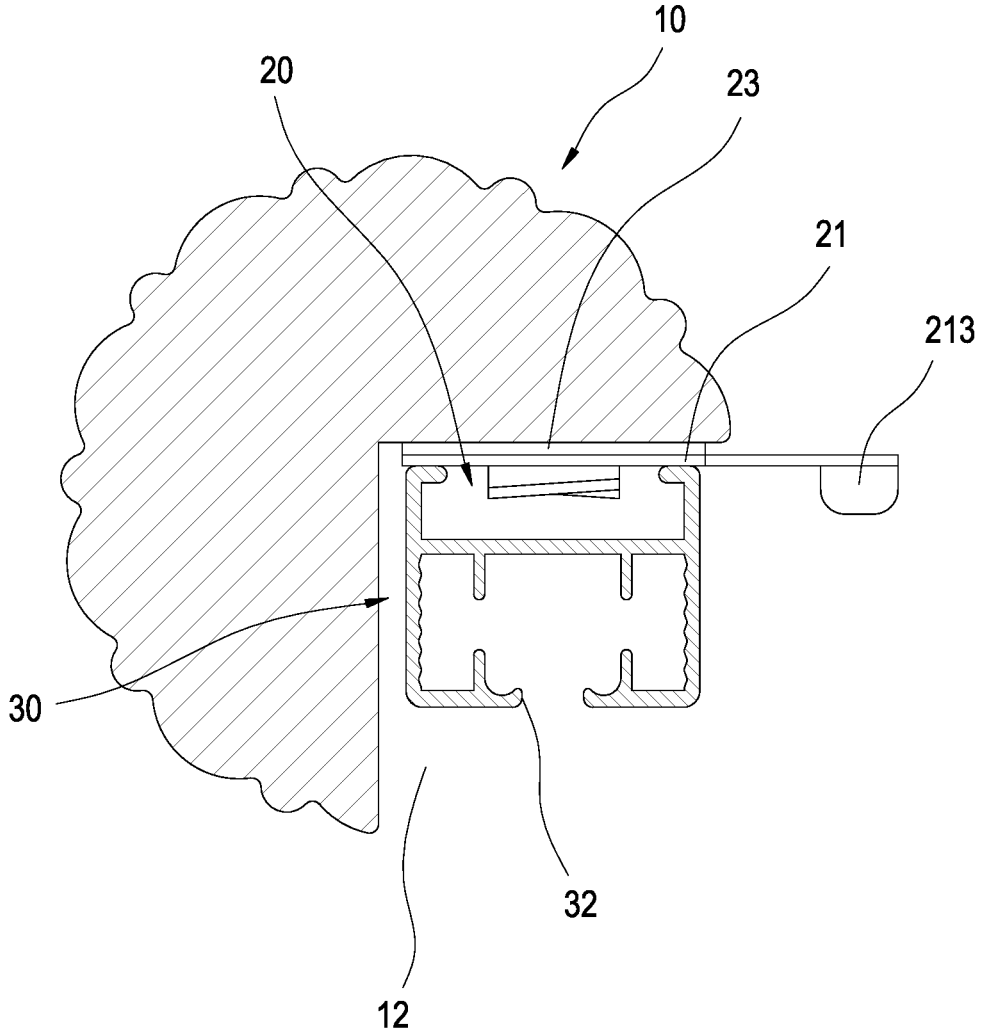
FIG. 4 is a cross sectional view of the combination structure of the decorative rod and the track in this disclosure.

Please refer to FIG. 1 to FIG. 3, which depict a perspective schematic view and an exploded perspective schematic view of the combination structure of the decorative rod and the track in this disclosure, and a perspective exploded schematic view of the locking set in this disclosure. This disclosure provides a combination structure of the decorative curtain rod and the track. The combination structure includes a decorative rod 10, a plurality of locking sets 20 and a track 30. The track 30 is combined on the decorative rod 10 through the locking sets 20.

The decorative rod 10 includes a rod body 11 and an L-shaped opening 12 disposed on a side of the rod body 11.

The L-shaped opening 12 is extended from one end of the rod body 11 to another end of the rod body 11. Furthermore, a plurality of decorative patterns 111 are disposed on an outer surface of the rod body 11. The arrangement of the decorative patterns 111 may enhance the aesthetics of the decorative rod 10.

In this embodiment, the decorative rod 10 further includes a pair of decorative heads 13, a pair of end plates 14 and a plurality of screws 15. The pair of end plates 14 are respectively disposed between each of the decorative heads 13 and each end of rod body 11 through the screws 15. Moreover, the pair of decorative heads 13 are combined on two ends of the rod body 11 opposite to each other. In some embodiments, each decorative head 13 is formed with a cover 131 on a side facing the rod body 11. The cover 131 is fastened on an end of the rod body 11.

The locking sets 20 are arranged spacedly on the rod body 11 at a side where the L-shaped opening 12 is located. Each of the locking sets 20 at least includes a locking plate 21 and a locking piece 22. The locking plate 21 includes a plate body 211 and a plurality of blocking pieces 212. The blocking pieces 212 are arranged in pair and spacedly on the plate body 211 to form an insertion space 210 respectively (refer to FIG. 6). Each of the locking plates 21 is combined on the rod body 11 and is rotatable through the locking piece 22.

Specifically, each of the locking plates 21 includes a handle 213. The handle 213 is disposed protrusively from the periphery of the locking plate 21 for the user to exert force to rotate the locking plate 21. Additionally, the locking plate 21 includes a stepped portion 214 located between the pair of the blocking pieces 212. The arrangement of the stepped portion 214 may enlarge the insertion space 210 for facilitating the insertion of the track 30.

In one embodiment of this disclosure, each of the locking sets 20 further includes a gasket 23. The gasket 23 is disposed between the locking plate 21 and an inner wall of the L-shaped opening 12. The arrangement of the gasket 23 may facilitate the rotation of the locking plate 21.

The track 30 includes a column 31 and a sliding slot 32 arranged on the column 31. The column 31 includes a fixing plate 311 and a pair of wings 312 bent and extended from two sides of the fixing plate 311. The pair of wings 312 and the sliding slot 32 are arranged on two sides of the fixing plate 311 opposite to each other.

Please refer to FIG. 4 to FIG. 7, which are a cross sectional view of the combination structure of the decorative curtain rod and the track in this disclosure, a schematic view of the locking plate of the locking set rotating for combining with the track in this disclosure, and a cross sectional view of the assembly of the decorative rod, the track and the curtain ring in this disclosure, and a schematic view of the decorative rod hanging with a curtain fabric in this disclosure. As shown in the FIG. 4, the decorative rod 10 needs to be fixed before assembling the track 30 of this disclosure, and the locking sets 20 are arranged on a wall of the L-shaped opening 12. Additionally, when assembling the locking sets 20, the locking piece 22 is inserted to the gasket 23 and the locking plate 21 to be combined on the upper wall of the L-shaped opening 12, and then the track 30 is placed on the bottom side of the locking sets 20.

It should be noted that when the track 30 is not positioned yet, an external force is required for supporting.

Figure 5:
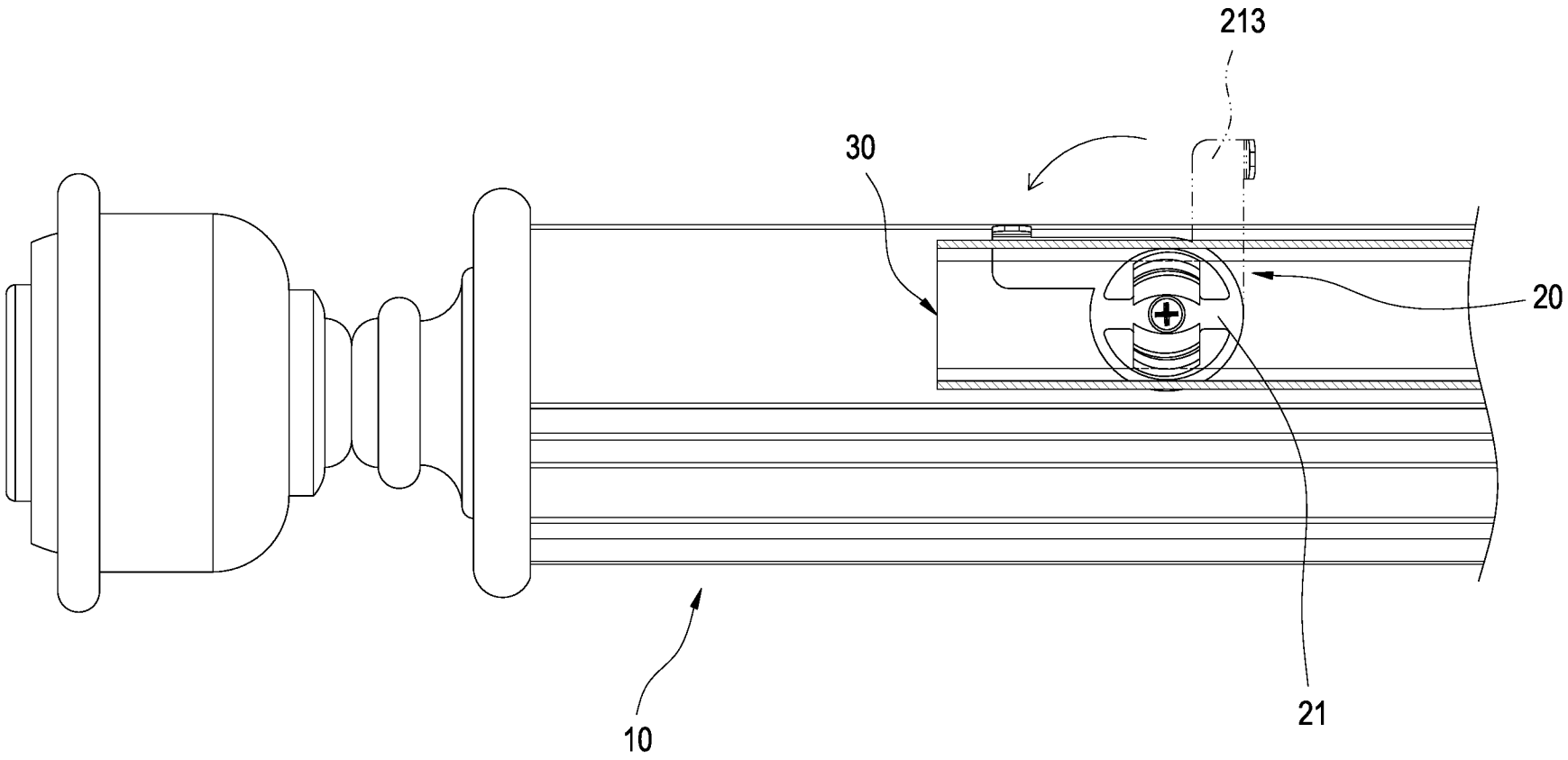
FIG. 5 is a schematic view of the locking plate of the locking set rotating to engage with the track in this disclosure.
Figure 6:
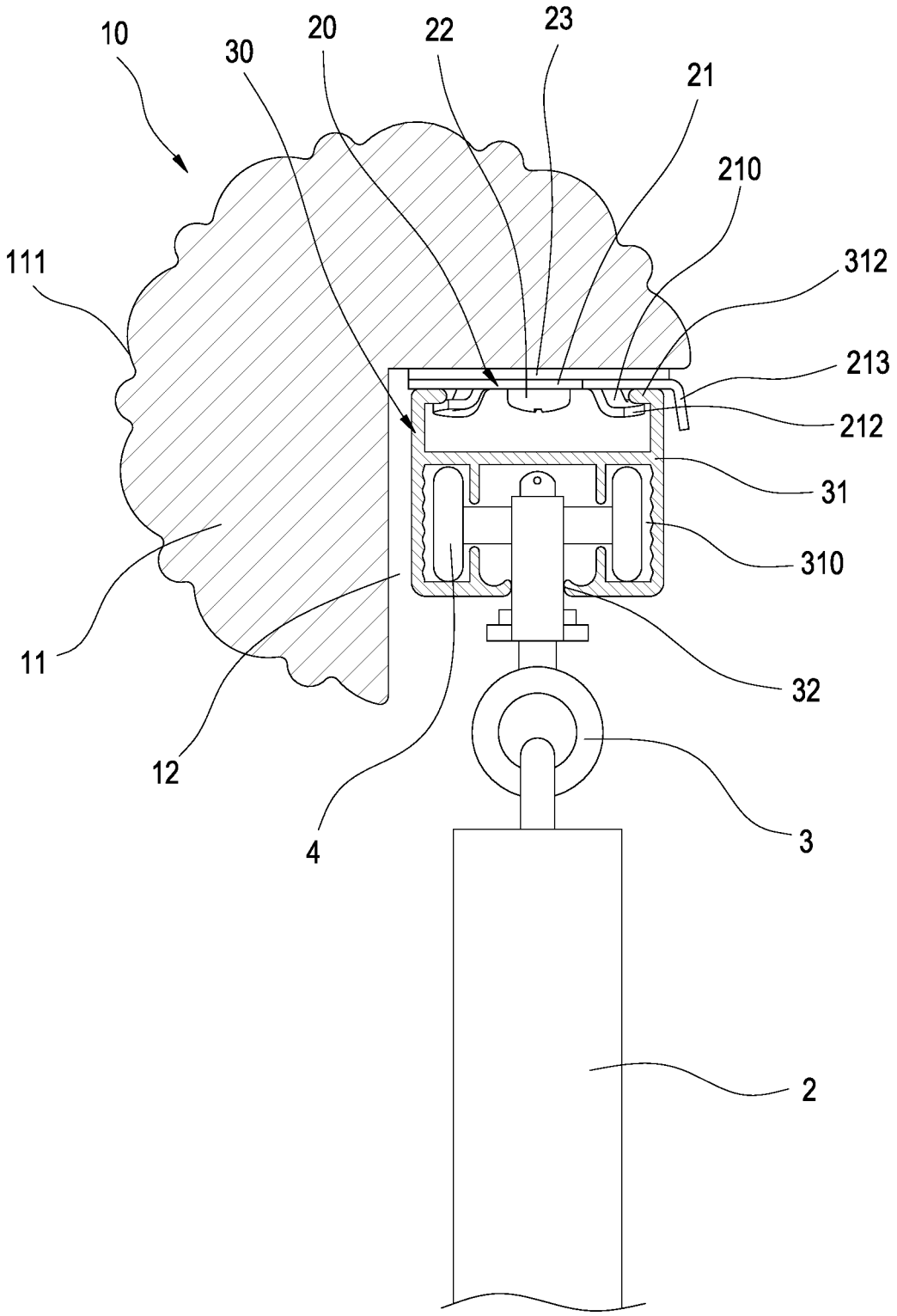
FIG. 6 is a cross sectional view of the assembly of the curtain decorative rod, the track, and the curtain ring in this disclosure.

As shown in FIG. 5 and FIG. 6, the handle 213 drives the locking plate 21 to rotate when being pulled by an external force. The wings 312 of the track 30 penetrate into the insertion space 210 of the locking plate 21 after the locking plate 21 rotates. Furthermore, the wings 312 of the track 30 are blocked by the blocking plates 212 to be positioned on the bottom side of the locking plate 21. Accordingly, the track 30 may be combined in the L-shaped opening 12 through the locking sets 20.

Figure 7:
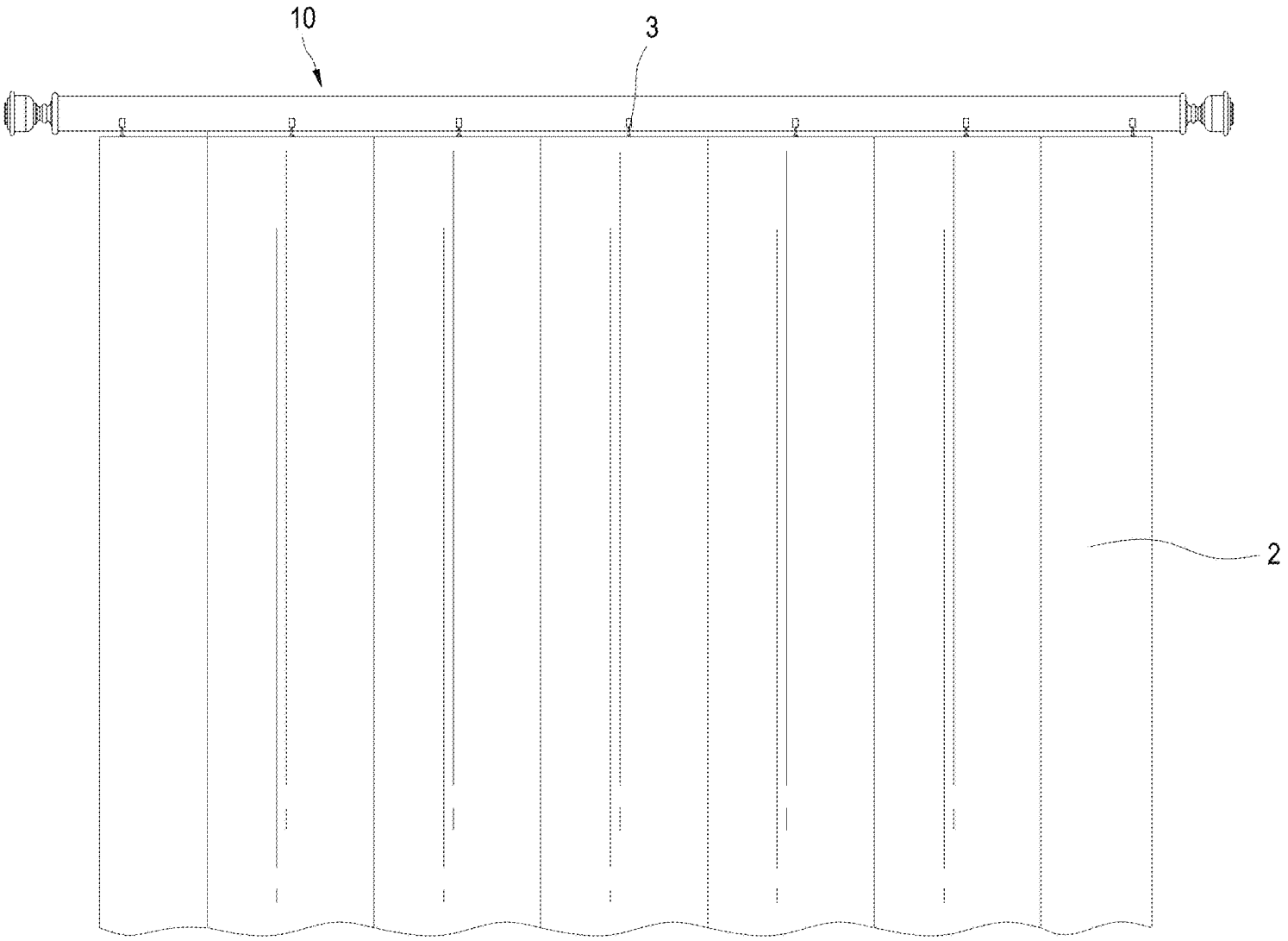
FIG. 7 is a schematic view of the curtain decorative rod hanging with a curtain fabric in this disclosure.

Please refer to FIG. 7, after the track 30 is combined on the decorative rod 10, a plurality of curtain rings 3 may be disposed on the track 30 for hanging a curtain fabric 2. In this embodiment, each curtain ring 3 is combined with the track 30 through a pair of pulleys 4. Specifically, the column 31 of the track 30 includes a pair of passageways 310 arranged on two sides of the sliding slot 32. The pair of pulleys 4 are arranged in the pair of passageways 310.

Figure 8:
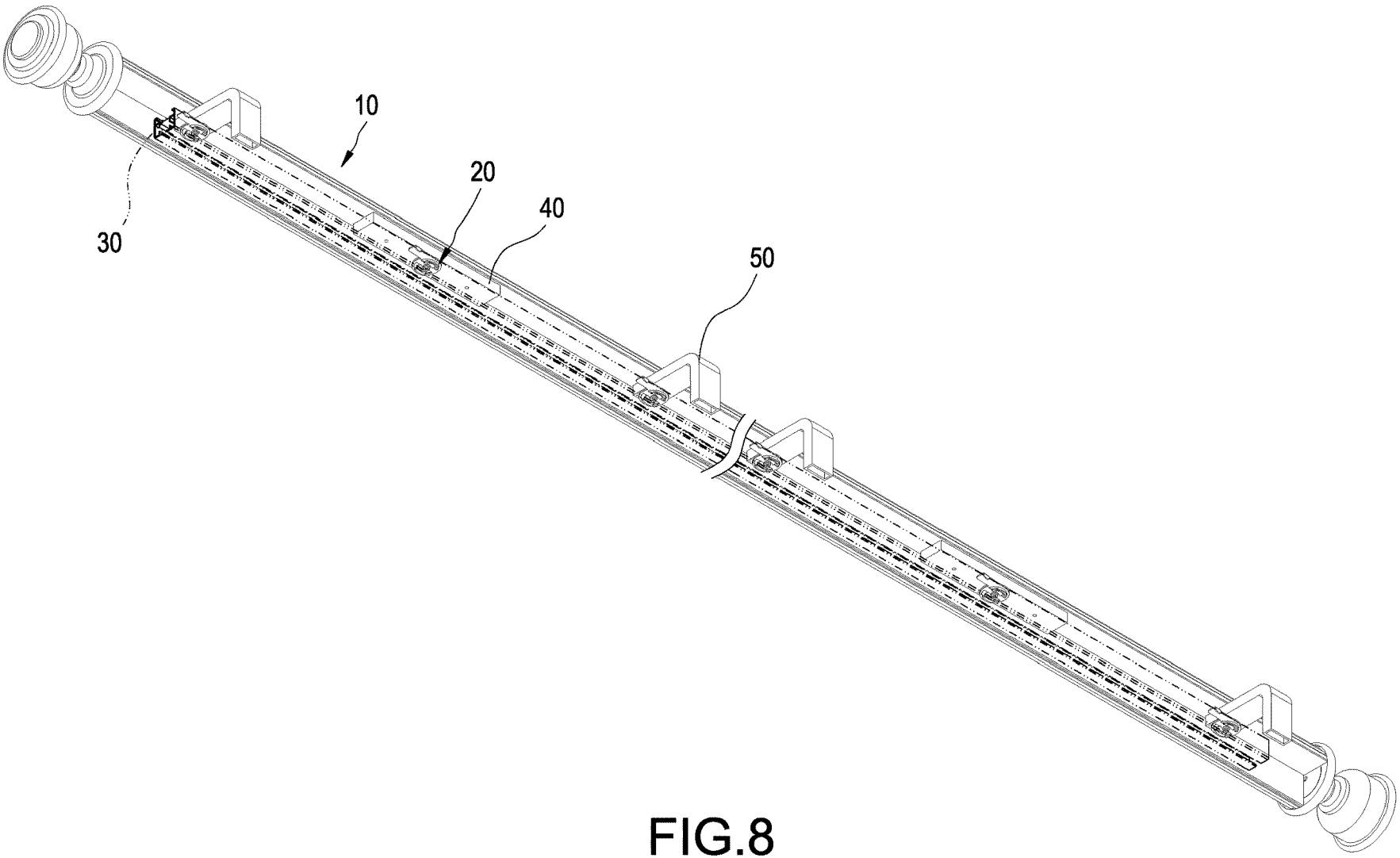
FIG. 8 is an operation schematic view of the supporting piece combing with the track through the locking sets in this disclosure.
Figure 9:
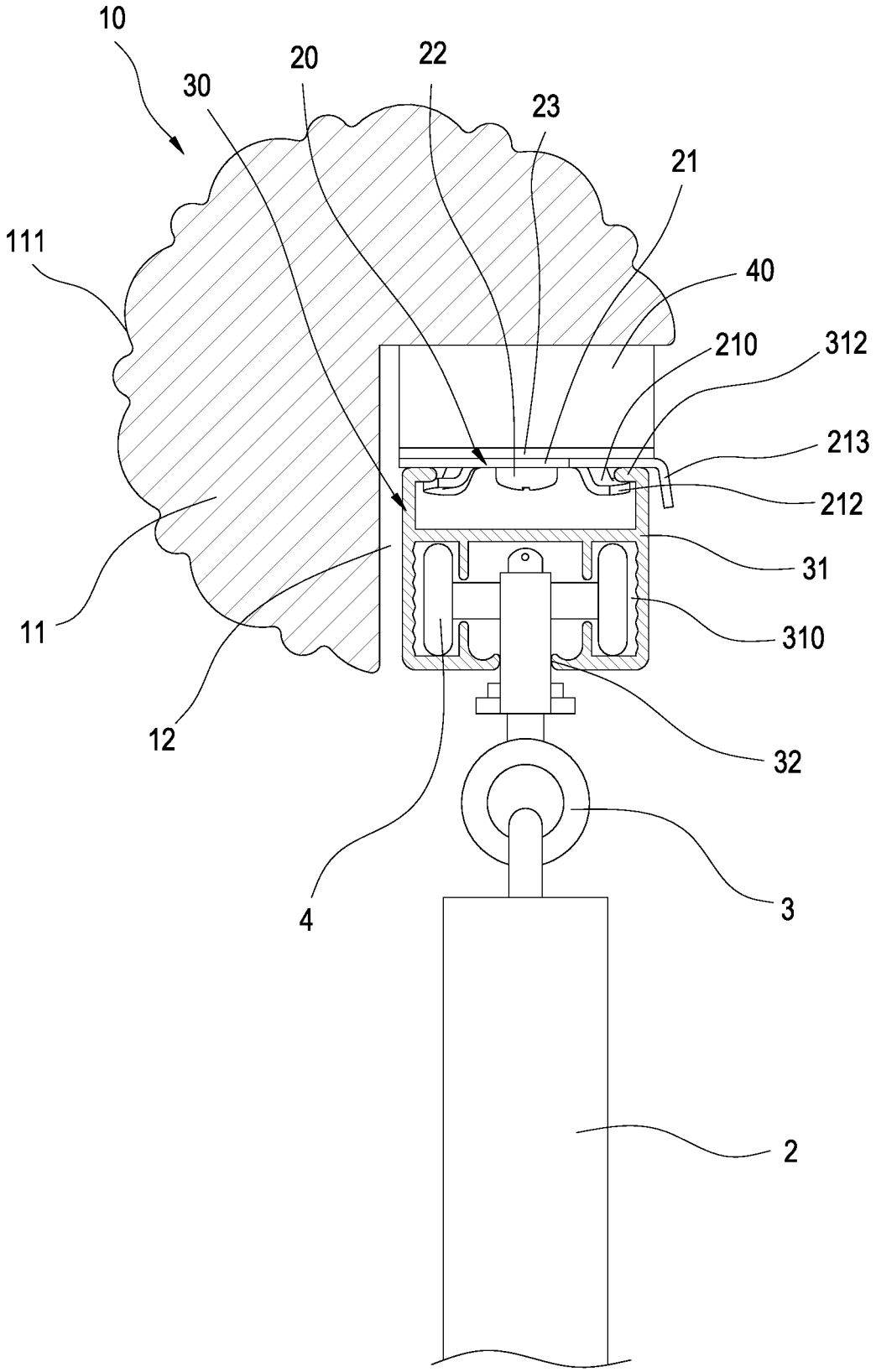
FIG. 9 and FIG. 10 are cross sectional views from two sides of the supporting piece and the track in this disclosure.
Figure 10:
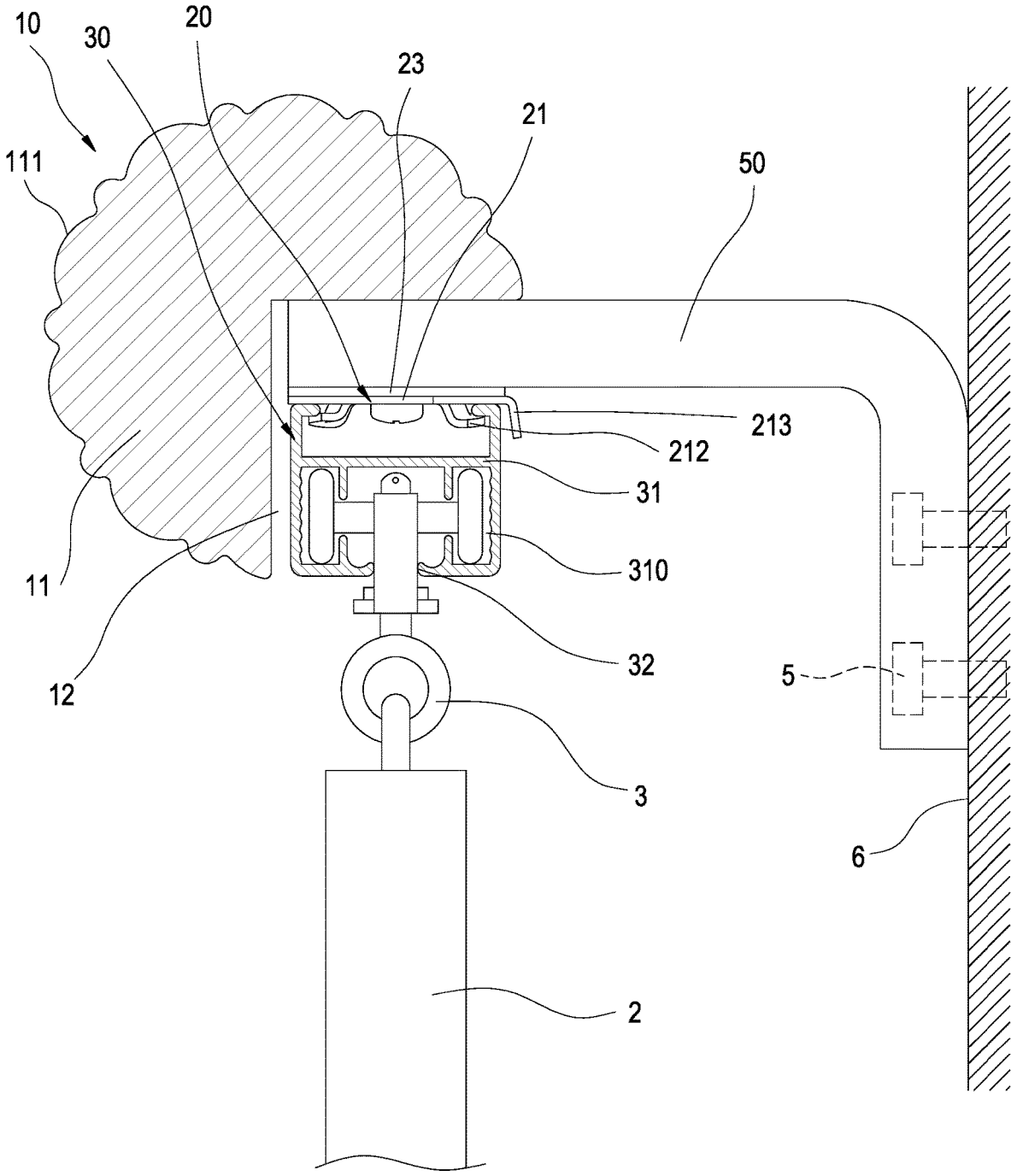

Please further refer to FIG. 8 to FIG. 10, which are an operation schematic view of the supporting piece combing with the track through the locking sets in this disclosure and two cross sectional views from two sides of the supporting piece and the track in this disclosure. The combination structure of the decorative curtain rod and the track in this disclosure further includes a plurality of supporting pieces 40 and a plurality of brackets 50. Each supporting piece 40 is arranged between the inner wall of the L-shaped opening 12 and the track 30 for adjusting the position of the track 30 in the L-shaped opening 12. Accordingly, one end of each bracket 50 may be combined with the track 30 through the locking sets 20 to be fixed in the L-shaped opening 12. Therefore, another end of each bracket 50 is fixed on a wall 6 through a plurality of screws 5 to support the decorative rod 10 and the track 30.

Please further refer to FIG. 9 and FIG. 10. One end of the bracket 50 of this disclosure is combined with the track 30 through the locking sets 20 to be fixed between the inner wall of the L-shaped opening 12 and the track 30. Furthermore, the assembly of the locking set 20 is described as above and here is omitted for brevity.

It should be noted that the track 30 of this disclosure is combined on the decorative rod 10 through the locking sets 20. Additionally, the brackets 50 are also combined with the track 30 through the locking sets 20. Therefore, when assembling the track 30 and the brackets 50, the locking sets 20 may be shared. As a result, the convenience of assembling is increased and the purpose of simplifying the assembling is achieved.

Figure 11:
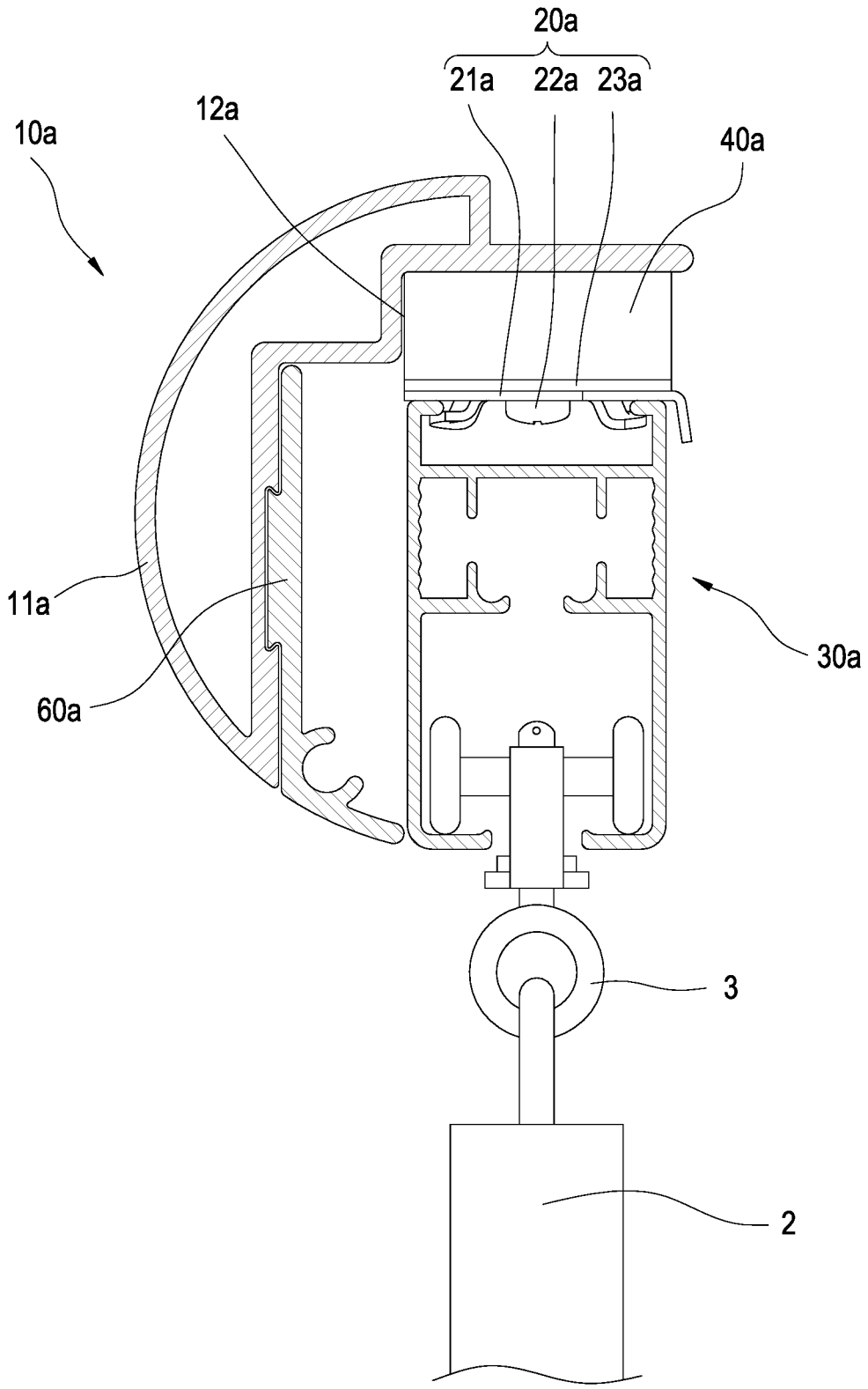
FIG. 11 and FIG. 12 are another embodiment of the combination structure of the decorative rod and the track in this disclosure.
Figure 12:
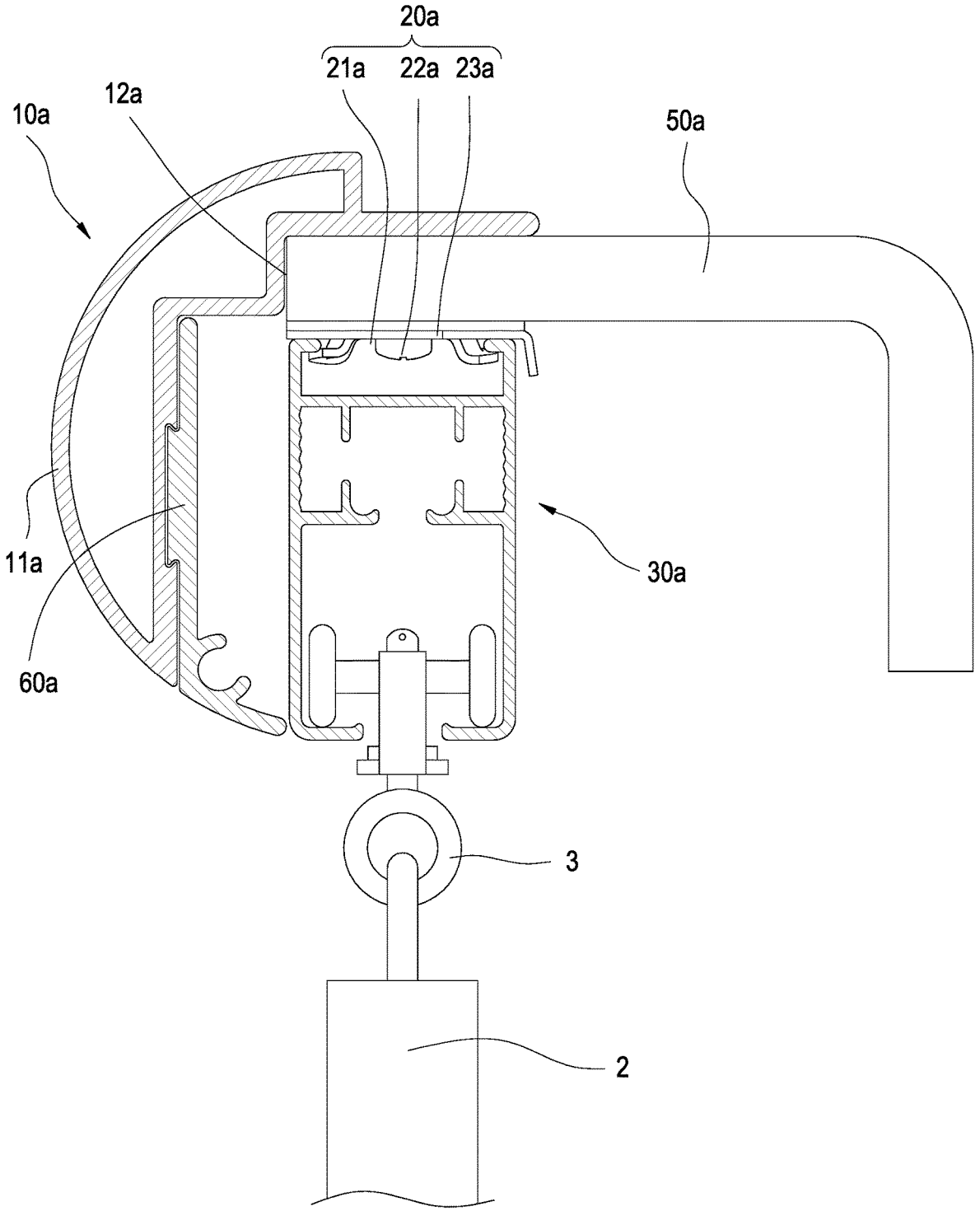

Please further refer to FIG. 11 and FIG. 12, which are another embodiment of the combination structure of the decorative rod and the track in this disclosure. The combination structure includes a decorative rod **10*a*, a plurality of locking sets 20*a*, a track 30*a*, a plurality of supporting pieces 40*a* and a plurality of brackets 50*a*. The decorative rod 10*a* includes a rod body 11*a* and an L-shaped opening 12*a* disposed on a side of the rod body 11*a*. The locking sets 20*a* are arranged spacedly on the rod body 11*a* at a side where the L-shaped opening 12*a* is located. Each of the locking sets 20*a* includes a locking plate 21*a*, a locking piece 22*a* and a gasket 23*a*. The track 30*a* is combined on the decorative rod 10*a* through the locking sets 20*a*. Each supporting piece 40*a* is arranged between the inner wall of the L-shaped opening 12*a* and the track 30*a* for adjusting the position of the track 30*a* in the L-shaped opening 12*a***.

Comparing with the previous embodiment, this embodiment is different in that the rod body **11*a* is a hollow metal rod. Moreover, the rod body 11*a* is further combined with a decoration plate 60*a* on the side facing the L-shaped opening 12*a*. The outer surface of the decoration plate 60*a* is connected to the bottom side of the rod body 11*a* for covering the bottom side of the rod body 11*a*. Additionally, the arrangement of the locking sets 20***a* and the other components is the same as that of the previous embodiment and here is omitted for brevity.

While this disclosure has been described by means of specific embodiments, numerous modifications and variations could be made thereto by those skilled in the art without departing from the scope and spirit of this disclosure set forth in the claims.

What is claimed is:

1. A combination structure, comprising:

a decorative rod (10), comprising a rod body (11) and an L-shaped opening (12) disposed on a side of the rod body (11), the L-shaped opening (12) extended from one end of the rod body (11) to another end of the rod body (11);

a plurality of locking sets (20), arranged spacedly in the L-shaped opening (12), each of the plurality of locking sets (20) comprising a locking plate (21) and a locking piece (22), the locking plate (21) comprising a plate body (211) and a plurality of blocking pieces (212), wherein the plurality of blocking pieces (212) are arranged in pair and spacedly on the plate body (211), an insertion space (210) is defined on the locking plate (21), and the locking plate (21) is combined on the rod body (11) through rotation of the locking piece (22); and a track (30), comprising a column (31) and a sliding slot (32) disposed on the column (31), the column (31) comprising a fixing plate (311) and a pair of wings (312) bent and extended from two sides of the fixing plate (311), wherein the pair of wings (312) and the sliding slot (32) are arranged on two sides of the fixing plate (311) opposite to each other;

wherein, the track (30) is combined in the L-shaped opening (12) through the locking plate (21) being configured to rotate to make the pair of wings (312) penetrate into the insertion space (210) and be blocked by the blocking pieces (212).

2. The combination structure according to claim 1, wherein the decorative rod (10) further comprises a pair of decorative heads (13), and the pair of decorative heads (13) are combined on two ends of the rod body (11).

3. The combination structure according to claim 2, wherein the decorative rod (10) further comprises a pair of end plates (14) and a plurality of screws (15), and the pair of end plates (14) are respectively arranged between each of the decorative heads (13) and each end of the rod body (11) through the screws (15).

4. The combination structure according to claim 2, wherein a cover (131) is disposed on a side of each of the decorative heads (13) facing the rod body (11), and the cover (131) is fastened on one end of the rod body (11).

5. The combination structure according to claim 1, wherein a plurality of decorative patterns (111) is disposed on an outer surface of the rod body (11).

6. The combination structure according to claim 1, wherein each of the locking sets (20) further comprises a gasket (23), and the gasket (23) is arranged between the locking plate (21) and an inner wall of the L-shaped opening (12).

7. The combination structure according to claim 1, wherein the locking plate (21) comprises a handle (213), and the handle (213) is disposed protrusively on a periphery of the locking plate (21).

8. The combination structure according to claim 1, wherein the locking plate (21) comprises a stepped portion (214) located between a pair of the blocking pieces (212).

9. The combination structure according to claim 1, wherein the column (31) comprises a pair of passageways (310) arranged on two sides of the sliding slot (32), and a pair of pulleys (4) are arranged in the pair of passageways (310), and the pair of pulleys (4) is combined with a curtain ring.

10. The combination structure according to claim 1, further comprising a plurality of supporting pieces (40), wherein each of the supporting pieces (40) is combined on the decorative rod (10) through each locking sets (20).

* * * * *